US010835777B2

(12) United States Patent
Taras et al.

(10) Patent No.: US 10,835,777 B2
(45) Date of Patent: Nov. 17, 2020

(54) PHYSICAL THERAPY APPARATUS AND METHOD OF USE

(71) Applicant: SUREFOOTED LLC, Homer Glen, IL (US)

(72) Inventors: Bradford C. Taras, Homer Glen, IL (US); Udai M. Jayakumar, Redondo Beach, CA (US)

(73) Assignee: SUREFOOTED LLC, Homer Glen, IL (US)

( * ) Notice: Subject to any disclaimer, the term of this patent is extended or adjusted under 35 U.S.C. 154(b) by 0 days.

(21) Appl. No.: 15/971,409

(22) Filed: May 4, 2018

(65) Prior Publication Data

US 2018/0318640 A1 Nov. 8, 2018

Related U.S. Application Data

(60) Provisional application No. 62/501,886, filed on May 5, 2017.

(51) Int. Cl.
*A63B 22/00* (2006.01)
*A63B 23/035* (2006.01)
(Continued)

(52) U.S. Cl.
CPC ..... *A63B 23/03541* (2013.01); *A61H 1/0262* (2013.01); *A61H 3/008* (2013.01);
(Continued)

(58) Field of Classification Search
CPC ..... A63B 21/0069; A63B 21/0125; A63B 2208/0204; A63B 23/03451;
(Continued)

(56) References Cited

U.S. PATENT DOCUMENTS 3,897,119 A 7/1975 McMurtrie
4,301,914 A 11/1981 Krammer
(Continued)

FOREIGN PATENT DOCUMENTS

CA 2942001 A1 * 10/2014 ..... A63B 21/156
KR 20100079428 A * 7/2010
WO 2010136924 A1 12/2010

OTHER PUBLICATIONS

Zhang M, Mar. 27, 2013,CN-102989120-A (Drawing and Abstract).*
(Continued)

*Primary Examiner* — Loan B Jimenez
*Assistant Examiner* — Kathleen Vermillera
(74) *Attorney, Agent, or Firm* — Brie A. Crawford; Crawford Intellectual Property Law LLC

(57) ABSTRACT

An apparatus and method for physical therapy includes a base structure, a roller table positioned on the base structure including a plurality of free motion rollers, at least one motor connected to the base structure, a plurality of powered rollers located within the base structure being in removable contact with the plurality of free motion rollers and connected to the at least one motor, a lifting mechanism located within the base structure and connected to the at least one motor and being configured to raise and lower the roller table, a load cell in communication with the apparatus being configured to measure and record a patient's response to the transition of the roller table, and a programmable logic controller in communication with the at least one motor and the load cell being configured to control the transition of the apparatus between the first mode and the second mode.

19 Claims, 5 Drawing Sheets

(51) Int. Cl.

| | |
|---|---|
| ***A63B 23/04*** | (2006.01) |
| ***A63B 26/00*** | (2006.01) |
| ***A63B 71/00*** | (2006.01) |
| ***A61H 1/02*** | (2006.01) |
| ***A61H 3/00*** | (2006.01) |
| ***A63B 22/02*** | (2006.01) |

(52) U.S. Cl.
CPC ..... *A63B 22/0285* (2013.01); *A63B 22/0292* (2015.10); *A63B 23/0417* (2013.01); *A63B 26/003* (2013.01); *A63B 71/0054* (2013.01); *A63B 2208/0204* (2013.01)

(58) Field of Classification Search
CPC ..... A63B 23/0417; A63B 23/03516; A63B 71/0054; A63B 22/02; A63B 22/0207; A63B 22/0235; A63B 22/0271; A63B 22/0278; A63B 22/0285; A63B 22/0292; A63B 26/003; A61H 1/0262; A61H 3/008; A61H 2201/5061; A61H 2201/5071; A61H 2201/5074; A61H 2201/5058; A61H 2201/0107; A61H 2201/12; A61H 2201/1207; A61H 2201/1215; A61H 2201/1269; A61H 2201/1261; A61H 2201/1418; A61H 2201/14; A61H 2201/1652; A61H 2201/50; A61H 2201/5007; A61H 2203/0406; A61H 2205/10; A61H 2205/106; A61H 2205/108
See application file for complete search history.

(56) References Cited

U.S. PATENT DOCUMENTS

| | | | | |
|---|---|---|---|---|
| 4,342,452 | A | 8/1982 | Summa | |
| 5,209,240 | A | 5/1993 | Jain et al. | |
| 5,337,757 | A | 8/1994 | Jain et al. | |
| 5,487,444 | A | 1/1996 | Dennington | |
| 5,569,129 | A | 10/1996 | Seif-Naraghi et al. | |
| 5,667,461 | A | 9/1997 | Hall | |
| 6,063,046 | A | 5/2000 | Allum | |
| 6,152,854 | A | 11/2000 | Carmein | |
| 6,302,828 | B1 | 10/2001 | Martin et al. | |
| 6,436,009 | B1 | 8/2002 | Marucci | |
| 7,341,025 | B1 | 3/2008 | Streeter et al. | |
| 7,806,807 | B2 | 10/2010 | Genua | |
| 8,968,161 | B2 | 3/2015 | Shapiro et al. | |
| 9,616,278 | B2 * | 4/2017 | Olson | A63B 22/0023 |
| 2003/0153438 | A1 | 8/2003 | Gordon et al. | |
| 2004/0009845 | A1 | 1/2004 | Johnson | |
| 2004/0116839 | A1 | 6/2004 | Sarkodie-Gyan | |
| 2005/0209061 | A1 | 9/2005 | Crawford et al. | |
| 2006/0052728 | A1 | 3/2006 | Kerrigan et al. | |
| 2006/0211957 | A1 | 9/2006 | Beny et al. | |
| 2006/0247104 | A1 | 11/2006 | Grabiner et al. | |
| 2009/0305853 | A1 | 12/2009 | Jordan | |
| 2010/0049105 | A1 * | 2/2010 | Joannou | A61H 1/005 601/49 |
| 2010/0268129 | A1 | 10/2010 | Park | |
| 2011/0082012 | A1 | 4/2011 | Charniga, Jr. et al. | |
| 2011/0312473 | A1 | 12/2011 | Chu et al. | |
| 2012/0071300 | A1 | 3/2012 | Shapiro et al. | |
| 2012/0108392 | A1 | 5/2012 | Chu et al. | |
| 2014/0206503 | A1 * | 7/2014 | Stockmaster | A61H 3/008 482/4 |
| 2014/0336009 | A1 | 11/2014 | Piaget et al. | |
| 2016/0175643 | A1 * | 6/2016 | Kueker | A63B 24/0087 482/5 |
| 2016/0228746 | A1 | 8/2016 | Jayakumar et al. | |
| 2017/0312582 | A1 * | 11/2017 | Root, Jr. | A63B 24/0087 |
| 2019/0105531 | A1 * | 4/2019 | Wu | A63B 22/02 |

OTHER PUBLICATIONS

Shang Y, Oct. 31, 2012, CN-202506048-U (Drawing and Abstract).*
International Search Report and Written Opinion for Int. App. No. PCT/US2018/031118, dated Jul. 12, 2018.
Degelau, J. et al.; "Prevention of Falls (Acute Care)"; Institute for Clinical Systems Improvement; updated Apr. 2012.
Luukinen, H., et al.; "Predictors for recurrent falls among the homedwelling elderly"; Scandinavian Journal of Primary Health Care, 13:4, pp. 294-299, 1995.
Oliver, D., et al.; "Risk factors and risk assessment tools for falls in hospital in-patients: a systemic review"; Age and Ageing, vol. 33, No. 2, pp. 122-130, 2004.
Pai, Y., et al.; "Perturbation Training Can Reduce Community-Dwelling Older Adults' Annual Fall Risk: a Randomized controlled Trial"; J Gerontol A Biol Sci Med Sci, vol. 69(12), pp. 1586-1594, Dec. 2014.
Salkeld, G., et al.; "Quality of life related to fear of falling and hip fracture in older women: a time trade off study"; BMJ, vol. 320, pp. 341-345, 2000.
Shumway-Cook, A., et al.; "Falls in the Medicare Population: Incidence, Associated Factors, and Impact on Health Care"; Physical Therapy, vol. 89, No. 4, pp. 324-332, 2009.
Wong, C.A., et al.; "The Cost of Serious Fall-Related Injuries at Three Midwestern Hospitals"; The Joint Commission Journal on Quality and Patient Safety, vol. 37, No. 2, pp. 81-87, 2011.
Yang, F., et al.; "Generalization of Treadmill-Slip Training to Prevent a Fall Following a Sudden (Novel) Slip in Over-Ground Walking"; J Biomech. vol. 46(1), pp. 63-69, 2013.
PCT International Search Report; International Searching Authority; dated Aug. 31, 2017, pp. 1-6, for International Application No. PCT/US2016/019458.
PCT International Written Opinion; International Searching Authority; dated Aug. 31, 2017, pp. 1-9, for International Application No. PCT/US2016/019458.
Yang, Feng, et al.; "Reduced intensity in gait-slip training can still improve stability"; Journal of Biomechanics, Apr. 2014, vol. 47, pp. 2330-2338.
Yang, Feng, et al.; "Correction of the inertial effect resulting from a plate moving under low-friction conditions"; Journal of Biomechanics, 2007, vol. 40, pp. 2723-2730.

* cited by examiner

PHYSICAL THERAPY APPARATUS AND METHOD OF USE

CROSS REFERENCE TO RELATED APPLICATIONS

The present application is a non-provisional of U.S. Provisional Patent Application No. 62/501,886 filed May 5, 2017, the entire contents of which are incorporated herein by reference.

BACKGROUND

Anyone can fall on a slippery surface. The elderly are at particularly increased risk of falls with increasing age, as demonstrated by staggering fall statistics that rise significantly with each decade of life above age sixty. This is a result of a natural slowing of reflexes as well as deconditioning and debility.

Falls are the leading cause of death by injuries among those aged 65 and over. Each year, more than 700,000 people suffer injuries from falls that result in hospitalizations. As people age, they are increasingly susceptible to falls as a consequence of diminished strength and delayed reaction time.

Falls among the elderly commonly lead to a loss of independence, particularly with activities of daily living (ADLs), reducing an individual's sense of dignity. Unfortunately, falls are the top reason individuals get admitted to nursing homes. The aging baby boomer population will further increase the demand for new technologies that keep them from falling and allow them to maintain an active lifestyle.

It has been shown that falls among the elderly have been reduced after a short training session on a device that simulates trips and slips. Such a device has the potential to vastly improve the unacceptably high morbidity and mortality from fall injuries, and also improve quality of life for patients while reducing the overall cost of healthcare. Thus, a need exists for such a training apparatus that is both practical to use in a clinical setting, and effective in simulating slips in a controlled and safe environment. With strength training and reflex training, users should achieve a reduced likelihood of falling for a long period of time after each training session.

Currently, products available to reduce fall risk in the market address single modes of cause, are often large, or are not effective in significantly reducing the public's fall risk. Existing therapies commonly create forced perturbations utilizing motorized movements of treadmill belts and traditional training methods, such as walking on foam matts, that are only helpful in improving strength and proprioception but have negligible impact on developing reflexes. It is more impactful to simulate a natural slip so that a person's neuromuscular system learns the reflexes needed to activate the appropriate muscles rapidly anticipate and counter a loss of balance after a loss in traction, thus preventing a fall after a slip.

Accordingly, there is a need for a physical therapy apparatus that is practical to use in a clinical setting, and also effective in simulating natural slips in a controlled and safe environment.

SUMMARY

In one embodiment, an apparatus for physical therapy is disclosed. The apparatus includes a base structure, a roller table positioned on the base structure, the roller table including an outer frame and a plurality of free motion rollers positioned within the outer frame, at least one motor connected to the base structure, a plurality of powered rollers located within the base structure and connected to the at least one motor, the plurality of powered rollers being positioned beneath and in contact with the plurality of free motion rollers, a lifting mechanism located within the base structure and connected to the at least one motor, the lifting mechanism being configured to raise and lower the roller table to transition the apparatus between a first position and a second position, a load cell in communication with the apparatus, the load cell being configured to sense and record a patient's response to the transition of the roller table from the first position to the second position, and a programmable logic controller (PLC) in communication with the at least one motor and the load cell, the PLC being configured to control the transition of the apparatus between the first position and the second position.

In another embodiment, the plurality of free motion rollers are aligned in two parallel columns along a single plane.

In another embodiment, the apparatus includes first and second motors, the first motor configured to provide power to the powered rollers and the second motor configured to provide power to the lifting mechanism.

In some embodiments, the first and second motors are positioned on a first side of the base structure.

In yet another embodiment, each of the plurality of powered rollers are positioned between two free motion rollers.

In another embodiment the lifting mechanism further includes four cams located within the base structure, wherein two first cams are positioned near an interior first side of the base structure and two second cams are positioned near an interior second side of the base structure, a vertical beam secured to each cam, and a first axle connecting the two first cams together and a second axle connecting the two second cams together, wherein one of the cams is secured to and powered by the at least one motor.

In another embodiment, the first axle is positioned off center within the outer circumference of each of the two first cams, thereby creating a smaller radius and a larger radius.

In another embodiment, in the first position, the four cams are positioned with the smaller radius being closer to the roller table and in line with the vertical beams, and in the second position, the four cams are positioned with the larger radius being closer to the roller table and in line with the vertical beams.

In yet another embodiment, the lifting mechanism further comprises four blocks, each block being secured to the base structure and to one of the vertical beams.

In another embodiment, the lifting mechanism further comprises four wheels, each wheel being mounted to one of the vertical beams.

In another embodiment, the apparatus further comprising a support structure secured to a ceiling, wherein the load cell is secured to the support structure.

In another embodiment, the apparatus further comprising a safety cord secured to the load cell, wherein the safety cord is configured to attach to a belt or harness on a patient.

In another embodiment, the PLC has an automated mode and a manual mode.

In another embodiment, the free motion rollers are constructed of elastic and high friction material.

In another embodiment, a method for using a physical therapy apparatus is disclosed. The method includes providing an apparatus including a base structure having a roller table positioned thereon, the roller table including an outer frame and a plurality of free motion rollers positioned within the outer frame, at least one motor connected to the base structure, a plurality of powered rollers located within the base structure and connected to the at least one motor, the plurality of powered rollers being positioned beneath the plurality of free motion rollers, and a lifting mechanism located within the base structure and connected to the at least one motor. The method further includes operating the apparatus in a first mode wherein a patient walks on the roller table in a first position in which the plurality of free motion rollers are in contact with the plurality of powered rollers, operating the apparatus in a second mode in which the lifting mechanism raises the roller table to a second position so that the plurality of free motion rollers are not in contact with the plurality of powered rollers, and sensing and recording a patient's response to the second mode via a load cell.

In another embodiment, the method further includes operating the apparatus in a third mode, in which the at least one motor provides a burst of increased acceleration, causing an increase of the speed of the roller table.

In yet another embodiment, the method further includes sensing and recording a patient's response to the third mode via the load cell.

In another embodiment, the method further includes sending the recorded response to a programmable logic controller.

In another embodiment, the lifting mechanism further includes four cams located within the base structure, wherein two first cams are positioned near an interior first side of the base structure and two second cams are positioned near an interior second side of the base structure, a vertical beam secured to each cam, and a first axle connecting the two first cams together and a second axle connecting the two second cams together, the first axle being positioned off center within the outer circumference of each of the two first cams, thereby creating a smaller radius and a larger radius, wherein one of the cams is secured to and powered by the at least one motor.

In another embodiment, the lifting mechanism raises the roller table by rotating the four cams to a position in which the larger radius is closer to the roller table and in line with the vertical beams.

DETAILED DESCRIPTION

The physical therapy apparatus of the present disclosure reduces physical harm to patients by preventing injuries from falling, while reconditioning overall mobility and reflexes. Specifically, the apparatus induces neuromuscular training through multiple simulations of powered slips and trips and natural slips and trips. A slip occurs when a patient's center of mass shifts posteriorly leading the subject to land on his/her backside. A trip is the opposite type of fall in which the patient's center of mass shifts anteriorly, thereby causing the subject to land on his/her front-side.

Patients are reconditioned with advanced reflexes which increase their stability and reduce injuries from falls. The simulations of the apparatus stimulate the monosynaptic and polysynaptic reflex circuits within the vestibular, ocular, vestibulo-ocular, cerebellar, and neuromuscular systems. Continual stimulations lead to safe recovery of the patient undergoing fall conditions.

In one embodiment, the apparatus includes a roller table with two parallel columns of freely moving rollers positioned above a base having powered rollers. The roller table rests on a lifting mechanism that can raise the roller table causing the freely moving rollers to disengage with the powered rollers, which allows the free motion rollers to transition from a powered treadmill to a highly slippery surface. The apparatus may be in communication with a load cell for monitoring patient falls, speed and other parameters, instrumentation to adapt equipment setting based on patient responses and a central programmable logic controller (PLC) mounted to the base structure to control the equipment operations, an Ethernet switch to communicate patient output with a data processing system and a central data processing system to suggest patient treatments and track patient progress.

In one embodiment, the apparatus is designed for patients to be used in a first mode, by walking on the roller table continuously in one direction like a treadmill. In a second mode, the apparatus simulates slippery conditions by disengaging the belt drive from the roller table, thereby reducing positive drive and allowing the individual rollers of the roller table to move freely, which results in patients having to manage highly slippery conditions, while supported from above by an external safety system. In a third mode, the roller table operates like a treadmill and the rollers are accelerated in a quick burst to cause the patient's feet to move from underneath their center of gravity and cause a forced fall.

Figure 1:
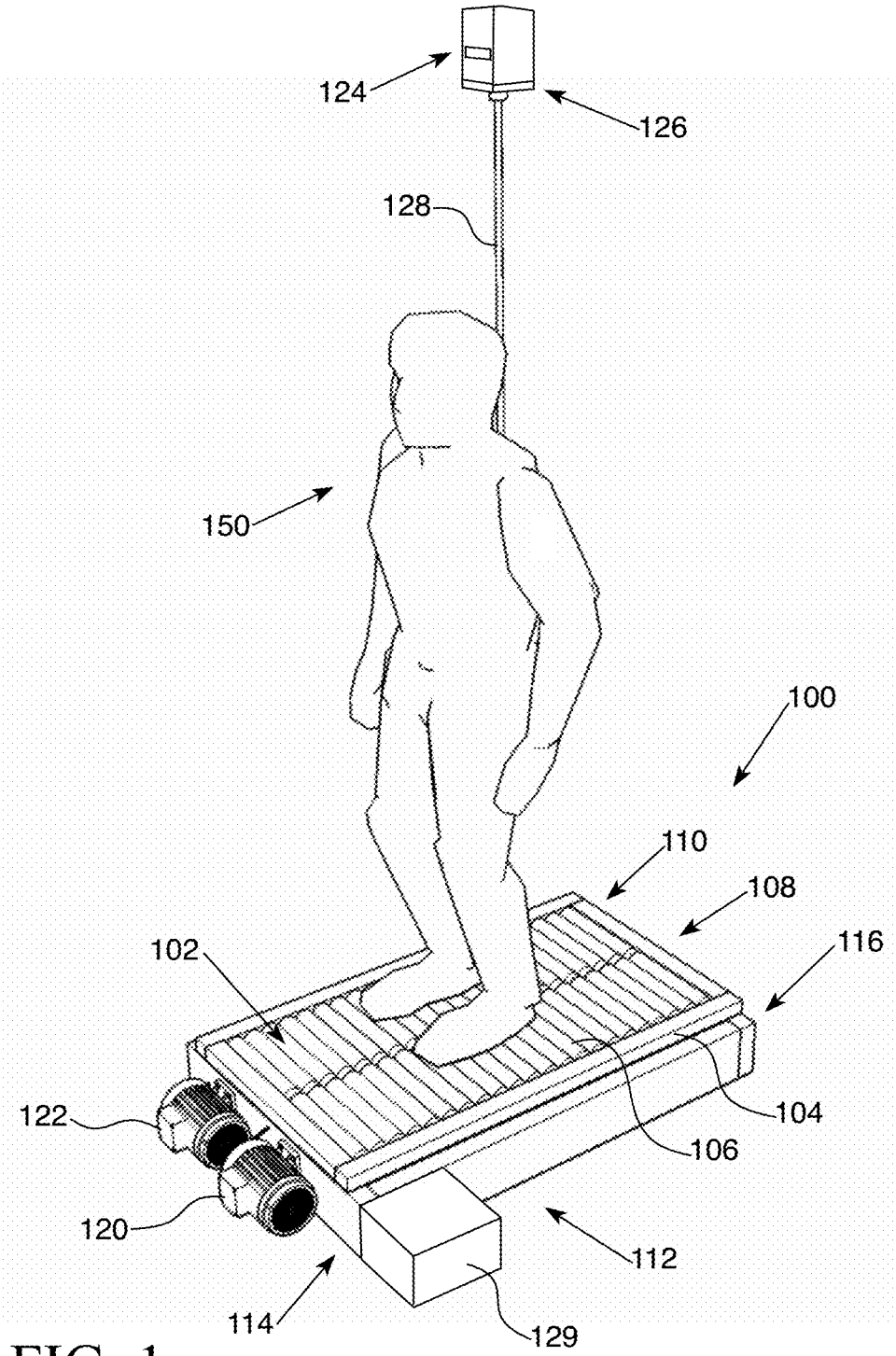
FIG. 1 shows an apparatus according to an embodiment of the disclosure.

As shown in FIG. 1, the apparatus 100 includes a roller table 102 upon which a patient 150 may stand and walk. The roller table 102 includes an outer frame 104 which supports a plurality of free motion rollers 106 in parallel. Each roller is positioned to an adjacent roller with little space in between, such as less than 1/16 in., for example, to prevent any pinch points, and to provide the maximum amount of rollers to support the patient, and also to enable the roller table 102 to feel more like a flat walking surface. In some embodiments, two columns 108, 110 of rollers 106 are positioned adjacent to each other within the outer frame 104. The two columns of rollers 108, 110 are separated to allow independent rotation and free biaxial motion for each of the patient's feet. In some embodiments, the free motion rollers 106 are constructed of elastic and high friction material.

Figure 2:
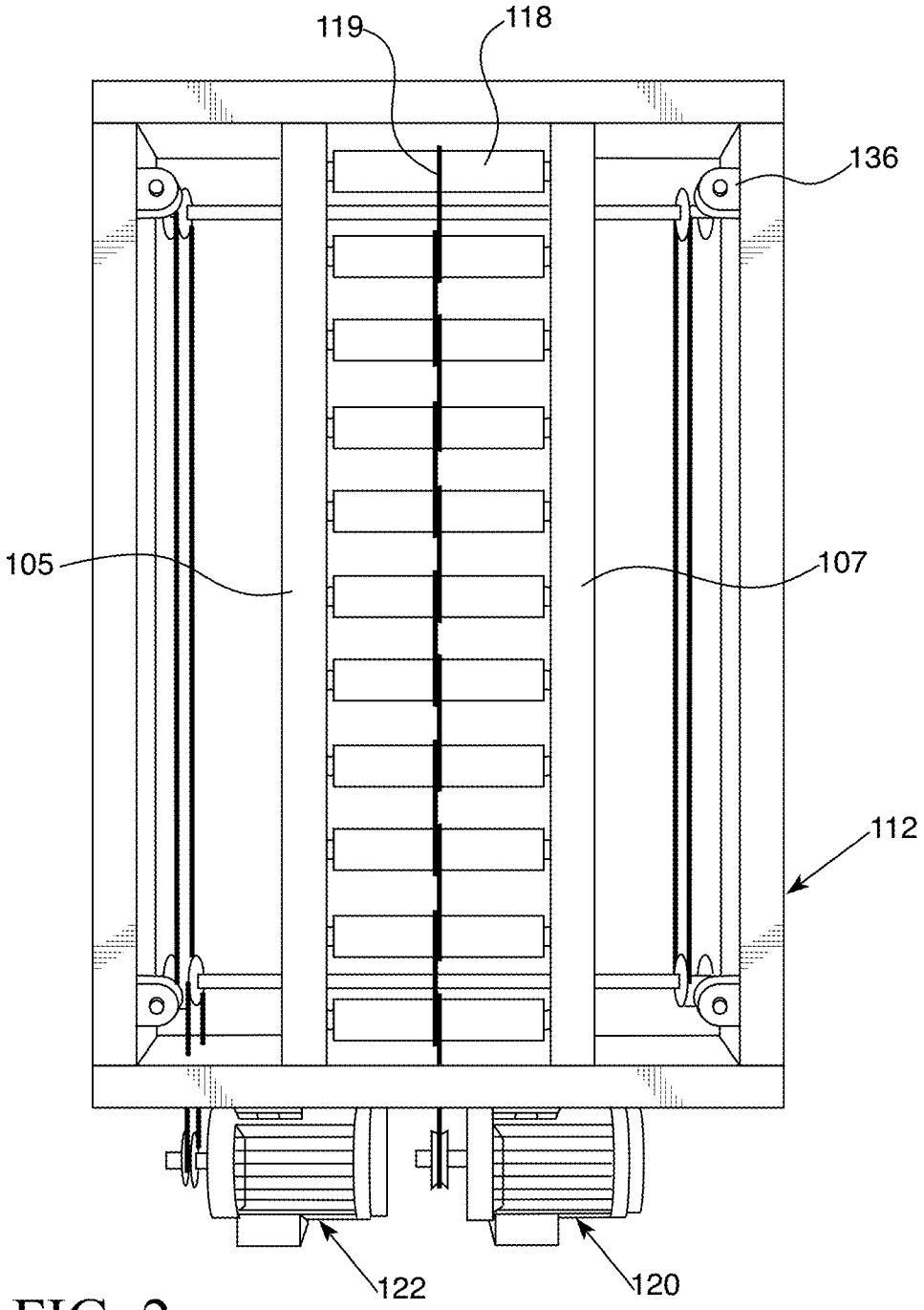
FIG. 2 shows a bottom view of the apparatus shown in FIG. 1.
Figure 3:
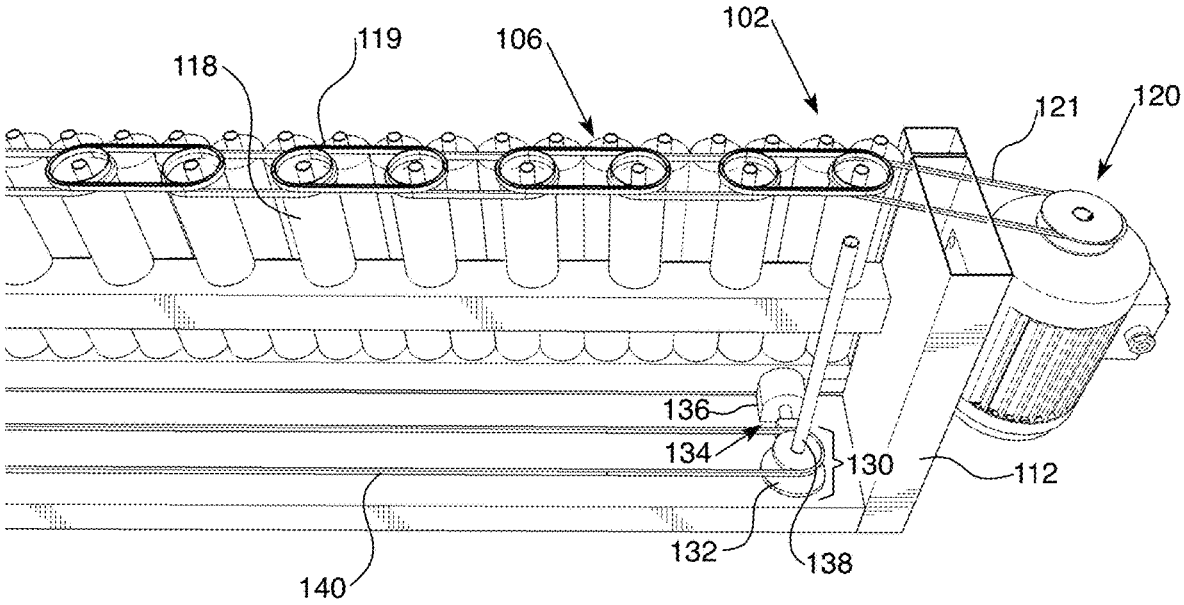
FIG. 3 shows a bottom perspective view of one half of the apparatus shown in FIG. 1.
Figure 4:
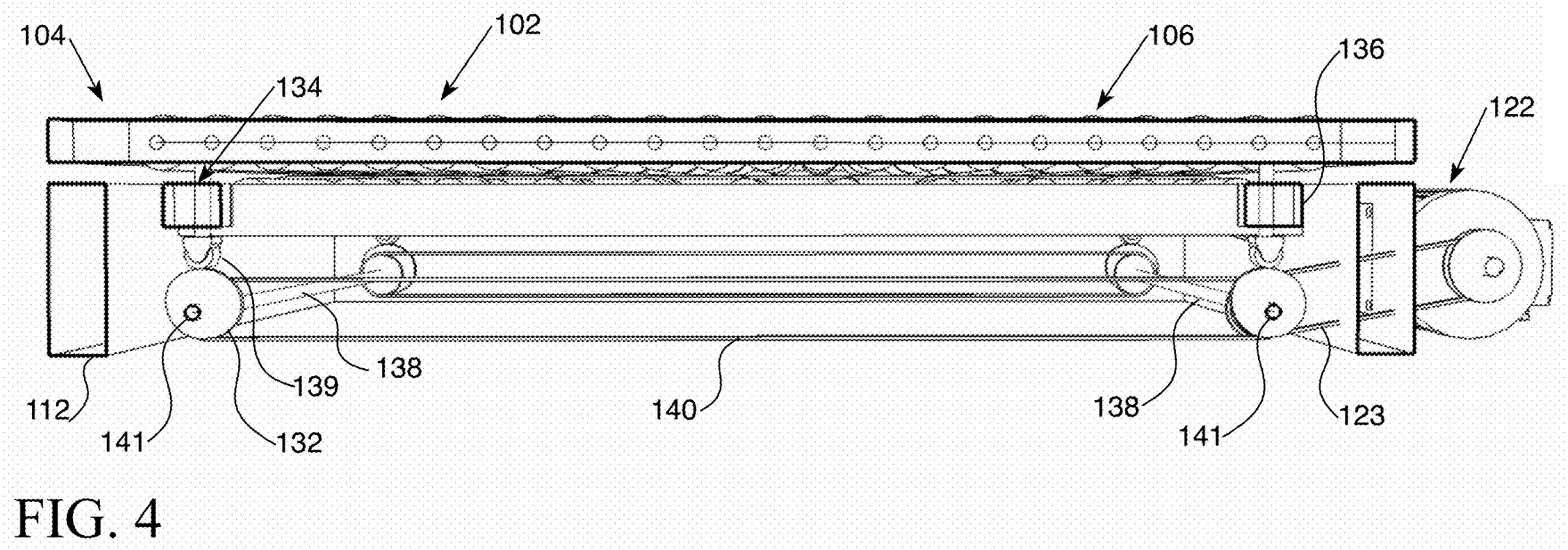
FIG. 4 shows a side cross-sectional view of the apparatus shown in FIG. 1.

The roller table 102 is situated atop a base structure 112. The base 112 includes a first end 114 and a second end 116. The base structure 112 houses a plurality of powered rollers 118 and a lifting mechanism 130, which are shown in FIGS. 2-4 and described in more detail below. As shown in FIG. 2, two internal members 105, 107 are positioned within the base structure 112 extending from the first end 114 to the second end 116. The powered rollers 118 are positioned between the internal members 105, 107.

The first end 114 of the base structure includes first and second electrical motors 120, 122. The first motor 120 provides power to the powered rollers 118. The second motor 122 provides power to the lifting mechanism 130. In some embodiments, only one motor is used to power both the powered rollers 118 and the lifting mechanism 130.

Referring again to FIG. 1, the apparatus 100 is in communication with a support structure 124 mounted to a ceiling of a physical therapy space. A load cell 126 is located within or secured to the support structure 124, and a safety cord 128 is connected to the load cell. The safety cord 128 attaches to a safety harness or belt (not shown) worn by the patient 150. The load cell 126 senses and records the patient response to the equipment's stimuli, like changes in slope, speed of mode. The load cell 126 is used to measure the amount of weight the patient relies on the safety structure during a fall. If no load is applied to the load cell, then no fall occurred. If the load cell measures less than half the weight of the patient, then the patient became off balance. If more than half the weight of the patient is measured by the load cell 126, then the event is recorded as a fall. The fall event information is recorded and can be utilized by a PLC (described below) to modify the number, type, or frequency of fall simulations. In some embodiments, the load cell 126 may be located within the safety harness or belt rather than in the support structure 124.

The apparatus 100 also includes a programmable logic controller (PLC) 129. The PLC 129 is connected to the base structure 112 and in communication with the first motor 120. In some embodiments, the PLC 129 is located in a panel mounted to the base structure 112. It should be understood that in alternate embodiments, the PLC 129 may be secured to any part of the base structure 112. The PLC 129 controls the switching of the apparatus between the first mode, the second mode, and the third mode, as described in more detail below. The PLC controls the actuations and the transitions between the first, second, and third modes by using an algorithm that incorporates fall data recorded from the load cell 126.

The PLC 129 has both a manually operated mode and an automated mode. A human machine interface (HMI) is needed to operate either mode and is linked to the PLC. The automated mode responds to patient stimuli gathered through the load cell 126 and/or additional instrumentation. As the patients improve and respond positively to the slip inducing stimuli, then the automated mode may increase the speed or frequency of slip and powered fall simulations.

The PLC 129 also compiles rotational data from a motor encoder (not shown) with timer input to calculate the velocity of the patient, and records the downward force a patient places upon the safety harness during slip and trip events using the load cell 126.

Referring now to FIG. 3, a bottom view of the interior of a portion of the base structure 112 is shown. The plurality of powered rollers 118 are positioned in parallel, and set to rest underneath and in between two free motion rollers 106. One of the powered rollers 118 is in contact with four (4) free motion rollers 106, two parallel sets of adjacent free motion rollers, and so there are less powered rollers 118 than free motion rollers 106 present on the apparatus 100. Although the outer frame 104 of the roller table 104 is the same length as the base 112, the outer frame 104 and the base 112 do not contact each other, because that would prevent the surfaces of the free motion rollers 106 from engaging with the surfaces of the powered rollers 118.

The first motor 120 provides power to the powered rollers 118, and is connected to the closest powered roller 118 through a chain or belt 121. Two powered rollers 118 are connected to one another via roller belts 119. The roller belts 119 rest in the gap that separates the two adjacent columns 108, 110 of free motion rollers 106 from FIG. 1. In some embodiments, the surface of the powered rollers 118 and the free motion rollers 106 may be slightly elastic and of high friction to assist the transfer of motion between the two while in treadmill mode.

Referring again to FIG. 3, the lifting mechanism 130 is shown. The lifting mechanism includes a plurality of elements positioned in each of the four interior corners of the base structure 112. In some embodiments, the lifting mechanism includes four cams 132 that rotate and change the height of four vertical beams 134. The vertical beams 134 are secured in position at four blocks 136, which are mounted to the inside wall of the base structure 112. Motion of the cams 132 is aligned by locking the two front cams together and the two back cams together with axles 138. Motion between the axles 138 is transferred using a chain 140 and sprockets 141 mounted to the end of the axles 138.

Figure 5:
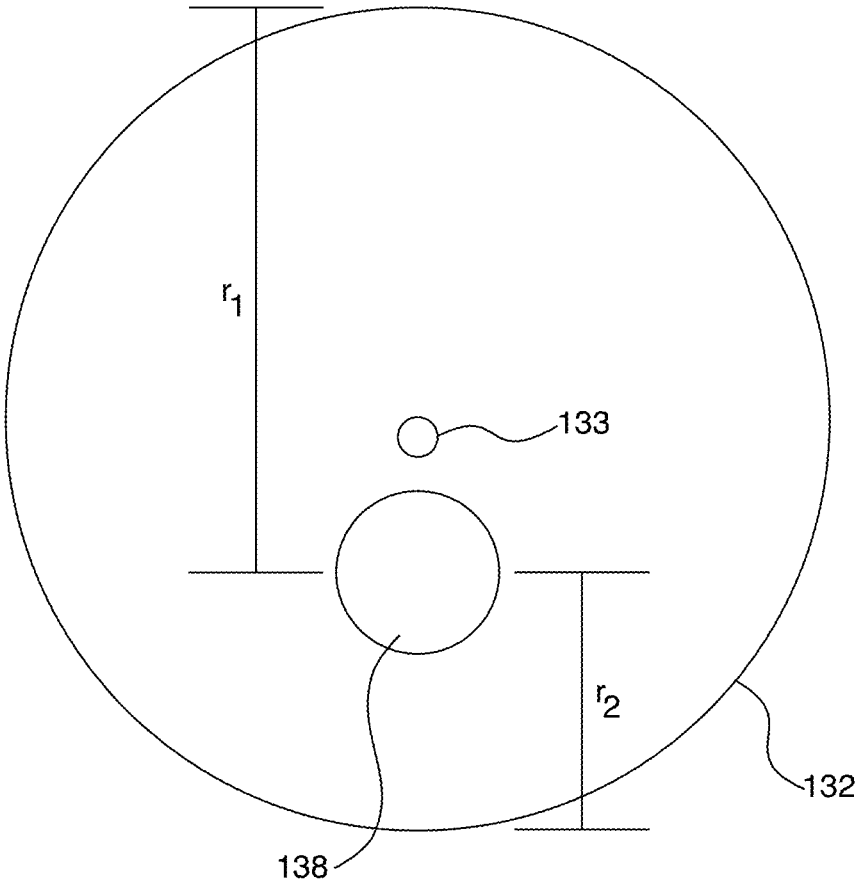
FIG. 5 shows a side view of a portion of the apparatus shown in FIG. 1.

FIG. 4 shows the apparatus 100 in a second position in which the lifting mechanism 130 has been actuated. As mentioned above, the second electrical motor 122 is used to power the lifting mechanism 130. The second motor 122 is connected to one of the axles 138 of the lifting mechanism 130 by a chain or belt 123. The axles 138 are positioned off center 133 within the outer circumference of the cams 132, as shown in FIG. 5. Thus, in one configuration, when the cams 132 are rotated to a point where the larger radius $r_1$ is positioned closer to the roller table 102 and in line with the vertical beams 134, the vertical beams 134 are raised or lifted upwardly toward the roller table 102, which in turn lifts the roller table 102 upwardly and away from the base 112, thereby disengaging contact between the powered rollers 118 and the free motion rollers 106. In a second configuration, where the smaller radius $r_2$ is positioned closer to the roller table 102 and in line with the vertical beams 134, the vertical beams 134 are lowered back down to their initial position, which in turn lowers the roller table down and toward the base 112, thereby returning to the roller table 102 to its original position so that the free motion rollers 106 engage the powered rollers 118.

In some embodiments, wheels 139 are mounted at the end of the vertical beams 134 between the vertical beams 134 and the cams 132 to help reduce friction and wear on the cams 132. In some embodiments, the wheels 139 may be mounted onto the vertical beam 134 by a bolt or any other suitable fastener. Any non-rotational motion of the wheels 139 and the vertical beams 134 is prevented because the beams 134 are locked in a horizontal position by the location blocks 136 mounted to the base structure 112. It should be understood that in alternate embodiments, any friction-reducing mechanism may be used instead of the wheels 139.

Notably, the lifting mechanism 130 of the present application does not include any pneumatic systems, thus reducing noise level of the apparatus, and also simplifying installation.

In operation, the apparatus 100 may operate in a first mode, which may be a walking or treadmill mode, a second mode, which may be a slip mode, and a third mode, which may be a trip mode. Initially, the apparatus 100 is in a starting position or stationary mode in which the roller table 102 is in a first position, where the free motion rollers 106 contact the powered rollers 118. The cams 132 are positioned with the smaller radius $r_2$ positioned closer to the roller table 102 and in line with the vertical beams 134. Depending upon whether the apparatus is being operated in an automatic or manual mode, either the PLC 129 or an operator triggers a signal to start the apparatus 100 in a first, or treadmill mode.

During the first mode, the speed of the first and second motors 120, 122 may be controlled and monitored by the PLC 129. The first motor 120 rotates, causing the chain or belt 121 to rotate the powered rollers 118. The rotational motion of the powered rollers 118 transfers to the free motion rollers 106, causing them to rotate as well. The patient 150 walks on the roller table 102 and remains at a constant position/height relative to the ground. The PLC controls the lifting mechanism 130 to transition the apparatus 100 from treadmill mode to the second or slippery mode. In the second, slippery mode, the second motor 122 rotates, causing the axles 138 and the cams 132 of the lifting mechanism 130 to rotate. In some embodiments, the second motor 122 rotates a predetermined number of times. After the predetermined number of rotations, the rotation stops when the cams 132 are positioned with the larger radius $r_1$ positioned closer to the roller table 102. Thus, the vertical beams 134 are lifted and therefore the roller table 102 is lifted about ¼ in. vertically to disengage the free motion rollers 106 from the powered rollers 118. Thus, the individual powered rollers 118 can move freely. When in slippery mode, every roller, including free motion rollers 106 and powered rollers 118, is free to move at extremely low friction. The patient is therefore only lifted slightly and should barely notice a change. The patient continues walking, but the surface is very slippery. The patient will therefore likely lose balance and fall. The load cell 126 senses the fall and records the fall signal, which is sent to either the PLC 129 (in automated mode) or logged by an operator (in manual mode). The apparatus 100 is then set back to the starting position or stationary mode. The roller table 102 and lifting mechanism 130 are returned to their original positions.

In the second mode, the roller table 102 and patient 150 are lifted to ensure that during breakdowns, the roller table will remain in contact with the powered rollers 118, and reduce the chance of a patient slipping on the free motion rollers 106 set in slippery mode. Also, the weight of the roller table 102 and patient 150 will generate sufficient friction between the surfaces of the free motion rollers 106 and the powered rollers 118, thereby reducing slippage between the two sets of rollers while in the first, or treadmill mode.

The apparatus 100 can also operate in a third, trip mode. During the third mode, the powered rollers 118 remain engaged with the free motion rollers 106, and the powered rollers undergo a burst of increased acceleration, which causes an unexpected increase of the speed of the roller table 102. In some embodiments, the first motor 120 can be configured to rotate either clockwise or counter-clockwise, allowing the powered rollers to roll either backward or forward. The patient 150 continues walking, but at a much greater pace, and will therefore likely lose their balance and fall. Similarly to the second mode, the load cell 126 senses the fall and records the fall signal, which is sent to either the PLC 129 (in automated mode) or logged by an operator (in manual mode). The apparatus 100 is then set back to the starting position or stationary mode. The roller table 102 and lifting mechanism 130 are returned to their original positions.

When in the first and third modes (treadmill and trip mode), all rollers (both free motion and powered) move in unison. The patient uses the apparatus 100 and patient data (such as, but not limited to, falls and imbalance events compared to simulation settings) gathered over time and is saved short term to a data logger connected to the PLC which is connected to all instrumentation. The operating algorithm on the PLC uses the patient data to modify treadmill speeds, directions and the frequency of slip mode and trip mode events. At the end of a patient session, the patient data is uploaded to a network switch that patches it into a database or enterprise system, such as an Electronic Medical Record (EMR) system that stores the patients' history. The data is also sent to an enterprise program that evaluates the data from the session and sends a final report to the equipment to be received by the physical therapist or technician managing the patient. This report provides progress of the patient over a series of sessions using the equipment. The database may also provide additional input to a physical therapist recommending other procedures leading to better patient outcome.

The apparatus disclosed herein may improve the excessive cost of fall injuries on our health system, while also improving quality of life for patients.

In another embodiment, the apparatus includes a base that allows the roller table and wheels (or other cylinders) to move at low friction along one or two axes of travel and houses the cylinder, to simulate walking up, down, or horizontally along a hill. These changes in slope can also be used for balance training while the user is standing still. The apparatus is connected to the internet through a managed switch to provide an enterprise system with documentation of the results of the patient's therapy session.

While various aspects and embodiments have been disclosed, other aspects and embodiments will be apparent to those skilled in the art. The various aspects and embodiments provided in this disclosure are for purposes of illustration and are not intended to be limiting, with the true scope being indicated by the following claims, along with the full scope of equivalents to which the claims are entitled.

We claim:

1. A physical therapy apparatus comprising:

a) a base structure;

b) a roller table positioned on the base structure, the roller table including an outer frame and a plurality of free motion rollers positioned within the outer frame;

c) at least one motor connected to the base structure;

d) a plurality of powered rollers located within the base structure and connected to the at least one motor, the plurality of powered rollers being positioned beneath and in disengageable contact with the plurality of free motion rollers;

e) a lifting mechanism located within the base structure and connected to the at least one motor, the lifting mechanism being configured to raise and lower the roller table to transition the physical therapy apparatus between a first position and a second position, wherein the lifting mechanism has at least one cam connected to at least one axle and the at least one cam is indirectly secured to at least one vertical beam via a wheel and the at least one vertical beam raises and lowers the roller table;

f) a load cell in communication with the physical therapy apparatus, the load cell being configured to sense and record a patient's response to the transition of the roller table from the first position to the second position; and g) a programmable logic controller (PLC) in communication with the at least one motor and the load cell, the PLC being configured to control the transition of the physical therapy apparatus between the first position and the second position.

2. The physical therapy apparatus of claim 1, wherein the lifting mechanism further includes:

a) the at least one cam being four cams located within the base structure, wherein two first cams of the four cams, being two first cams, are positioned near an interior of a first end of the base structure and two remaining two cams, being two second cams, are positioned near an interior of a second end of the base structure;

b) the at least one vertical beam being four vertical beams and each of the four vertical beams is indirectly secured to one of the four cams, wherein each of the four vertical beams is indirectly secured to a different cam via a wheel;

c) the at least one axle being a first axle and a second axle wherein, the first axle connects the two first cams together and a second axle connects the two second cams together; and d) wherein one of the cams, through either the first axle or the second axle, is secured to and powered by the at least one motor.

3. The physical therapy apparatus of claim 2, wherein the first axle is positioned off center within an outer circumference of each of the two first cams and the second axle is positioned off center within an outer circumference of each of the second two cams, thereby creating a smaller radius and a larger radius for each cam.

4. The physical therapy apparatus of claim 3, wherein the first position, the four cams are positioned with the smaller radius being closer to the roller table and in line with the four vertical beams, and in the second position, the four cams are positioned with the larger radius being closer to the roller table and in line with the four vertical beams.

5. The physical therapy apparatus of claim 2, wherein the lifting mechanism further comprises four blocks, each block being secured to the base structure and to one of the four vertical beams, wherein each of the four blocks is secured to a different vertical beam.

6. The physical therapy apparatus of claim 1, further comprising the at least one motor being first and second motors, the first motor configured to provide power to the plurality of powered rollers and the second motor configured to provide power to the lifting mechanism.

7. The physical therapy apparatus of claim 6, wherein the first and second motors are positioned on a first end of the base structure.

8. The physical therapy apparatus of claim 1, wherein the plurality of free motion rollers are aligned in two parallel columns along a single plane.

9. The physical therapy apparatus of claim 1, wherein each of the plurality of powered rollers are positioned between two free motion rollers.

10. The physical therapy apparatus of claim 1, further comprising a support structure secured to a ceiling, wherein the load cell is secured to the support structure.

11. The physical therapy apparatus of claim 1, further comprising a safety cord secured to the load cell, wherein the safety cord is configured to attach to a belt or harness on a patient.

12. The physical therapy apparatus of claim 1, wherein the PLC has an automated mode and a manual mode.

13. The physical therapy apparatus of claim 1, wherein the plurality of free motion rollers are constructed of elastic material.

14. A method of using a physical therapy apparatus comprising:

a) providing an apparatus comprising:

i) a base structure having a roller table positioned thereon, the roller table including an outer frame and a plurality of free motion rollers positioned within the outer frame;

ii) at least one motor connected to the base structure;

iii) a plurality of powered rollers located within the base structure and connected to the at least one motor, the plurality of powered rollers being positioned beneath the plurality of free motion rollers; and iv) a lifting mechanism located within the base structure and connected to the at least one motor, wherein the lifting mechanism has at least one cam connected to at least one axle and the at least one cam is indirectly secured to at least one vertical beam via a wheel and the at least one vertical beam raises and lowers the roller table;

operating the apparatus in a first mode wherein a patient walks on the roller table in a first position in which the plurality of free motion rollers are in contact with the plurality of powered rollers;

b) operating the apparatus in a first mode wherein a patient walks on the roller table in a first position in which the plurality of free motion rollers are in contact with the plurality of powered rollers;

c) operating the apparatus in a second mode in which the lifting mechanism raises the roller table to a second position so that the plurality of free motion rollers are not in contact with the plurality of powered rollers; and d) sensing and recording a patient's response to the second mode via a load cell.

15. The method of claim 14, further comprising operating the apparatus in a third mode, in which the at least one motor provides a burst of increased acceleration, causing an increase of a speed of the roller table.

16. The method of claim 15, further comprising sensing and recording a patient's response to the third mode via the load cell.

17. The method of claim 14, wherein the lifting mechanism further comprises:

a) the at least one cam being four cams located within the base structure, wherein two of the first four cams, being two first cams, are positioned near an interior first end of the base structure and the remaining two cams, being two second cams, are positioned near an interior second end of the base structure;

b) the at least on vertical beam being four vertical beams and each of the four vertical beams is indirectly secured to one of the four cams, wherein each vertical beam is indirectly secured to a different cam via a wheel;

c) a first axle connecting the two first cams together and a second axle connecting the two second cams together, the first axle being positioned off center within an outer circumference of each of the two first cams and the second axle being positioned off center within an outer circumference of each of the second two cams, thereby creating a smaller radius and a larger radius for each cam; and d) wherein one of the cams, through either the first axle or the second axle, is secured to and powered by the at least one motor.

18. The method of claim 17, wherein the lifting mechanism raises the roller table by rotating the four cams to a position in which the larger radius is closer to the roller table and in line with the four vertical beams.

19. The method of claim 14, further comprising sending the recorded patient response to a programmable logic controller.

* * * * *